US006318421B1

(12) United States Patent
Lagache

(10) Patent No.: US 6,318,421 B1
(45) Date of Patent: Nov. 20, 2001

(54) LIMIT CONTROL DEVICE FOR FILLING A LIQUID STORAGE TANK

(75) Inventor: Roland Lagache, Lège (FR)

(73) Assignee: Lafon Production, Paris (FR)

( * ) Notice: Subject to any disclaimer, the term of this patent is extended or adjusted under 35 U.S.C. 154(b) by 0 days.

(21) Appl. No.: 09/581,591

(22) PCT Filed: Nov. 23, 1998

(86) PCT No.: PCT/FR98/02500

§ 371 Date: Jun. 14, 2000

§ 102(e) Date: Jun. 14, 2000

(87) PCT Pub. No.: WO99/31011

PCT Pub. Date: Jun. 24, 1999

(30) Foreign Application Priority Data

Dec. 16, 1997 (FR) ..... 97 15955

(51) Int. Cl.[7] ..... B65B 1/04
(52) U.S. Cl. ..... 141/198; 137/430
(58) Field of Search ..... 141/198, 95; 137/429, 137/430, 433

(56) References Cited

U.S. PATENT DOCUMENTS

| | | | | |
|---|---|---|---|---|
| 1,289,490 | | 12/1918 | Lunstrom . | |
| 1,689,066 | | 10/1928 | Baxter . | |
| 3,625,264 | * | 12/1971 | Swain | 141/198 |
| 3,929,155 | * | 12/1975 | Garretson | 137/430 |
| 4,444,230 | * | 4/1984 | Van Mullem | 141/198 |
| 4,667,711 | | 5/1987 | Draft | 141/198 |

FOREIGN PATENT DOCUMENTS

| | | |
|---|---|---|
| 0312320 | 4/1989 | (EP) . |
| 0415991 | 3/1991 | (EP) . |
| 0433151 | 6/1991 | (EP) . |
| 2324965 | 4/1977 | (FR) . |
| 2476790 | 8/1981 | (FR) . |
| 2656062 | 6/1991 | (FR) . |

* cited by examiner

*Primary Examiner*—Steven O. Douglas
(74) *Attorney, Agent, or Firm*—Ostrolenk, Faber, Gerb & Soffen, LLP

(57) ABSTRACT

A limit control device for filling a liquid storage tank has a hollow upper body, a plunger tube integral with the upper body, a valve mounted in the hollow upper body and capable of moving between an opening position and a closing position, a valve seat arranged in the hollow upper body and whereon the valve is urged to rest in a closing position, a floater vertically mobile in a chamber arranged at least partially inside the plunger tube. The device is characterized in that the floater is integral with a moving element forming a piston, the moving element being displaced by thrust of the liquid acting on one of its ends.

12 Claims, 1 Drawing Sheet

LIMIT CONTROL DEVICE FOR FILLING A LIQUID STORAGE TANK

FIELD OF THE INVENTION

Figure 1:
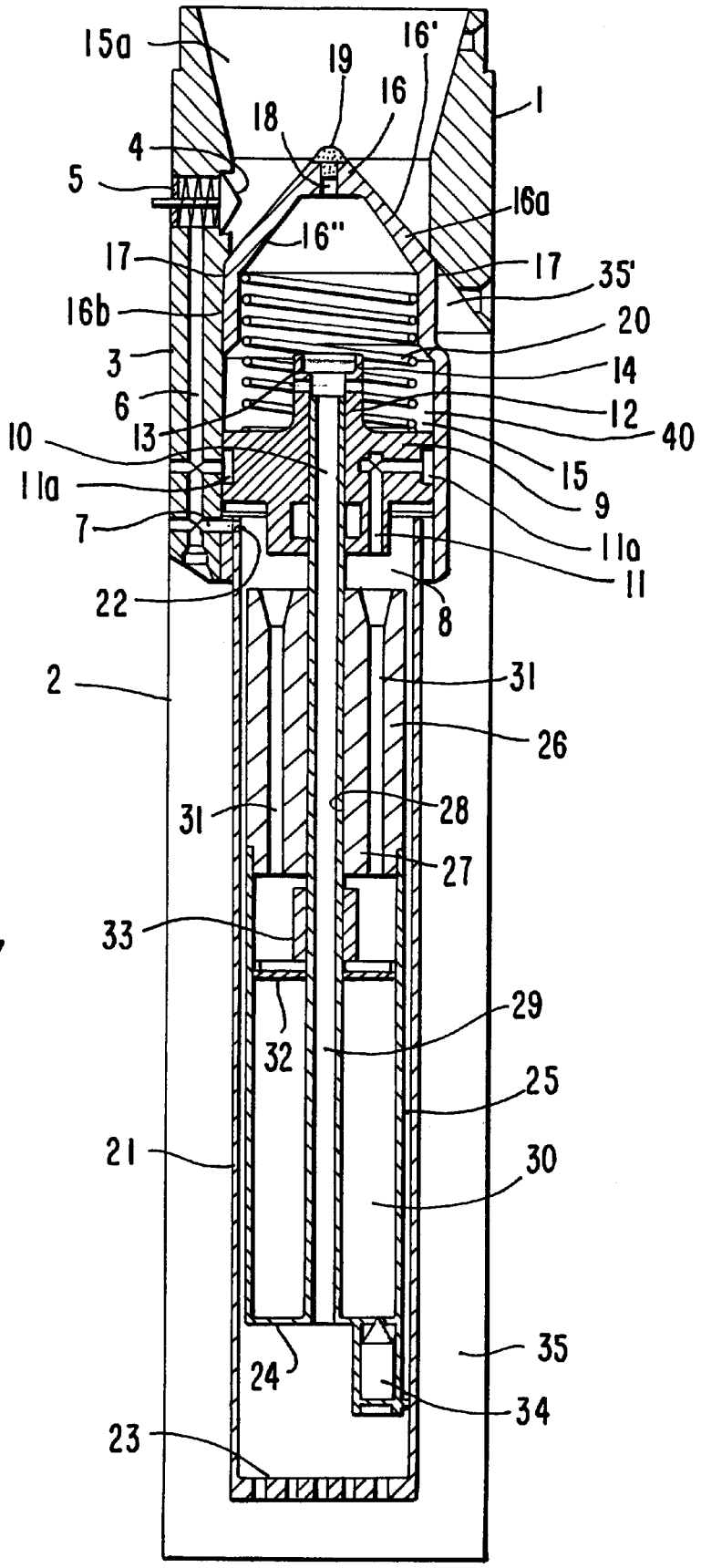

The present invention relates to a fill limiter for a liquid storage tank.

It is known practice for a buried or overhead storage tank intended to hold a liquid to be fitted with a fill limiter, the function of which is to interrupt the filling of the tank when the liquid in the said tank reaches a predetermined level, so as to prevent overflow which would be damaging to the surroundings of the tank. This is especially desirable when the tank that is to be filled is located in a service station delivering hydrocarbons of various types.

The simplest limiters in terms of structure comprise a body, a valve element mounted in the said body and able to move between an open position corresponding to the filling of the tank and a closed position corresponding to the interruption of the filling of the said tank; a float connected to the said valve element accompanies the rise of the liquid in the tank so as to close the valve when the liquid in the tank reaches a predetermined level.

Many improvements have been made to limiters according to whether the storage tanks are equipped with manholes or inlet orifices for positioning limiters inside the storage tank.

In American U.S. Pat. Nos. 1,289,490 and 1,689,066, the limiters comprise a tube body equipped with an internal partition to delimit two adjacent chambers arranged side by side, one of the chambers acting as a passage for the liquid that is intended to fill the tank and the other being used to accommodate a float which is connected to a valve element which can be moved from an open position corresponding to a low liquid level in the tank, located below the float, into a closed position that corresponds to a high liquid level in the tank, this level still being below the shut-off valve. In this prior art, the valve is always reopened manually. What is more, and this is a serious drawback, there is no possibility of reopening the valve when the person performing the filling does not interrupt his filling action when the valve is in the closed position.

Other limiters have recently been proposed. Such limiters are described, for example, in patent 89/16604, European patent 0,415,991, patent 0,312,320, and U.S. Pat. No. 4,667,711.

BACKGROUND OF THE INVENTION

Each of the limiters described in these patents or patent applications comprises a float which is connected to the valve element so that, as the liquid in the tank rises, it is moved away from the limiter body. When the limiter is introduced into the tank inlet orifice, the float is at least partially housed in the body so as to reduce the space occupied by the limiter.

However, such limiters, because of the travel of the float outside the body, cannot allow the tank to be filled to the maximum extent. This is because it is necessary to leave a minimum amount of space between the upper wall of the tank and the uppermost position of the float.

Patent FR-90/10353 describes a limiter in which the float is mounted in a chamber formed parallel to the duct through which the fluid passes and delimited inside the limiter body by a dividing partition, the said float being connected by a linkage to the valve element so that the float is moved mechanically as the liquid in the storage tank rises. When the float reaches a predetermined level of liquid in the tank, the rod connecting the float and the valve element pushes the latter into its closed position.

The devices briefly described hereinabove do not allow the liquid introduced into the tank to be ducted and do not allow the liquid to be prevented from raining down into the said tank, so as to eliminate excessive foaming in the storage tank. What is more, these devices are not always suited to reducing or even eliminating the risk of explosion which exists at the time of communication between the outside and the gaseous headspace in which the air and the gas are confined. This risk of explosion may occur if the float rises at an inopportune moment.

OBJECTS OF THE INVENTION

The object of the present invention is to overcome the aforementioned drawbacks and to provide a limiter which allows the liquid to be ducted as it passes along the dip tube so as to considerably reduce the extent to which the liquid rains down onto the bottom of the tank and thus reduce the foaming in the said tank.

SUMMARY OF THE INVENTION

The subject of the present invention is a limiter of the type comprising a fill limiter for a liquid storage tank, the said limiter being intended to be at least partially introduced into the said storage tank and comprising a hollow upper body, a dip tube secured to the said upper body, a valve element mounted in the said hollow upper body and capable of being moved between an open position and a closed position, a valve seat formed in the said hollow upper body and against which the said valve element rests in the closed position, a float which can move vertically in a chamber formed at least partially inside the dip tube, characterized in that the said float is secured to moving parts forming a piston, the said moving parts being moved by the thrust of the liquid exerted on one of their ends.

According to another feature of the present invention, the moving parts comprise the float and a piston body secured to the said float and in which an annular chamber is formed about a through passage, the said moving parts being placed in an internal tube which is housed inside the dip tube and which is secured to the upper body.

According to another feature of the present invention, a central bore is formed in the float and is approximately coaxial with the said through passage of the piston body, a tube being placed in the said central bore of the float.

According to another feature of the present invention, the float comprises at least one through passage, one end of which opens into a front chamber formed between an intermediate piece secured to the upper body and the said float, and the other end of which opens into the piston body.

According to another feature of the present invention, the valve element is of cylindro-conical shape and is equipped at the top of the cone with a passage to allow the front face and rear face of the said valve element to communicate.

According to another feature of the present invention, the intermediate piece comprises at the top, on the one hand, a limit stop against which the tube of the float abuts, and, on the other hand, two orifices, through which a downstream chamber formed at the rear of the piston can be connected to the inside of the said tube, the said tube being able to move in a central passage formed in the intermediate piece.

According to another feature of the present invention, the intermediate piece comprises at least one duct via which the front chamber can be connected to a lateral duct formed on one side of the said upper body, the said lateral duct being connected, via a valve, to the upstream side the valve element.

According to another feature of the present invention, the internal tube is closed at its lower end by a grating.

According to another feature of the present invention, the internal tube comprises, at its upper part, an air discharge orifice communicating with a vent orifice formed in the upper body.

According to another feature of the present invention, the piston body is equipped with a valve element at its lower end.

One advantage of the present invention lies in the fact that the parts are isolated from the action of the liquid when the storage tank is being filled.

Other advantages and features will become better apparent upon reading the description of a preferred embodiment of the invention and from studying the appended drawing in which the single figure depicts a sectioned view of the limiter, the valve element being in the closed position.

SPECIFIC DESCRIPTION

As shown in FIG. 1, the limiter according to the invention comprises a hollow upper body 1 which is extended by a drop tube 2 fixed to the said upper body 1. Mounted in one lateral side 3 of the said upper body 1 is a small valve 4 which is urged towards the open position by a spring 5. A lateral duct 6 provides the communication between the space in which the small valve 4 and the spring 5 are mounted, and the front chamber 8.

An intermediate piece 9 is mounted, in a leaktight and fixed manner, in the upper body 1, the said intermediate piece comprising a central passage 10 and a port 11*a* communicating with some small ducts 11 providing the connection between the duct 6 and the front chamber 8. Formed in the top 12 of the intermediate piece 9 are two small orifices 13 and a limit stop 14 is mounted above the said orifices 13.

A cylindro-conical valve element 16 is mounted in the upper body 1 and delimits therein an upstream chamber 15*a* located on the same side as the front face 16' and in which the liquid with which the tank is being filled arrives, and a downstream chamber 15 located on the same side as the rear face 16". The conical part 16*a* of the valve element 16 is arranged in the upstream chamber 15*a* when resting on a valve seat 17 formed on the interior wall 1*a* of the upper body 1. The cylindrical part 16*b* rests on the lateral part 3 of the upper body. A passage 18 forming a port is formed in the conical part of the valve element 16, the said passage allowing communication between the upstream chamber 15*a* and the downstream chamber 15. A small grating 19 is mounted at one end of the passage 18 and forms a kind of filter for the liquid to prevent small solid particles present in the liquid from entering the downstream chamber 15. A spring 20 is housed in the downstream chamber 15 and rests against the base of the conical part of the valve element 16 and the intermediate piece 9.

A stationary internal tube 21 is mounted in a chamber 35 of the dip tube 2 and is secured, by the upper part, to the upper body 1. An orifice 22 made at the upper part of the internal tube 21 places the front chamber 8 in communication with the vent orifice 7. The internal tube 21 is closed at its lower end by a grating 23 which is a filter or strainer which prevents the inside of the internal tube 21 from being pressurized. Moving parts 24 forming a piston are mounted in the internal tube 21 and comprise a piston body 25, a float 26 secured to the piston body 25, and a tube 27 placed in a central bore 28 made in the float 26. The piston body 25 comprises a through passage 29 which is approximately coaxial with the tube 27 and an annular chamber 30 formed about the through passage 29. The float 26 comprises at least one, and preferably two, through passages 31 which provide a connection between the front chamber 8 and the annular chamber 30 through a pierced plate 32 against which there bears a leaktight clamping cuff 33 which allows the tube 27 and the piston body 25 to be held securely together, each of the through passages 31 opening at one end into the front chamber 8 and at the other end into the piston body 25. A valve 34 is provided at the lower part of the annular chamber 30.

The way in which the fill limiter according to the present invention works is as follows.

When the person responsible for filling the tank has connected the filling hose of the tanker lorry to the limiter and has opened the shut-off valve mounted on the tanker lorry and/or the pump if filling is being performed using a pump, the pressure of the liquid, which may vary between 50 mbar and 8 bar, opens the valve by moving the valve element 16 off its seat 17, against the action of the preloaded spring 20. As soon as the valve 16 has opened, the liquid flows mainly through the lateral passage 35' delimited by the valve element 16 and the upper body 1 into the dip tube 2 to reach the bottom of the reservoir that is to be filled with liquid. During the filling phase, the pressure in the internal tube 21 is zero. A small amount of liquid also and at the same time flows through the grating 19 and the port 18 to fill the chamber 15. Liquid passes from the chamber 15 into the tube 27 via the orifices 13, and then into the through passage 29, after which it passes into the reservoir through the lower strainer 23. There is sufficient clearance between the tube 21 and the moving parts 24.

When the liquid rises up inside the internal tube 21 and reaches the lower end of the moving parts 24, the valve 34 shuts off the drainage orifice of the annular chamber 30. When the level of liquid reaches a first level $N_1$ in the reservoir, the moving parts 24, pushed by the liquid in the internal tube 21, reach a raised position in which the upper end of the tube 27 is in abutment against the elastomeric limit stop 14. The leakage orifices 13 are shut off by the tube 27 and the communication between the chamber 15 and the tube 27 is interrupted. The pressure in the chamber 15 therefore increases and the valve element 16 moves into a closed position against its seat 17 under the action of the spring 20 and because of the difference in the surface areas 16' and 16" of the valve element 16. At that instant, the person responsible closes the shut-off valve or stops the pump and the liquid on either side of the valve element decompresses by virtue of a small decompression nozzle 40 mounted in the bottom part of the upper body 1 and on the same side as the lateral passage 35 for the flow of liquid towards the storage tank. This decompression continues until the pressure of the liquid is below 50 mbar. However, and for a pressure below 50 mbar, the valve 4 opens and the liquid located above the closed valve 16 enters the duct 6 and flows along the port 11*a* and into the small ducts 11 of the intermediate piece 9 and then into the front chamber 8. The liquid let into the front chamber 8 flows along the through passages 31 then fills the annular chamber 30. This filling of the annular chamber 30 has the effect of weighting down the moving parts 24 which move back down again. The downwards movement of the moving parts 24 causes the tube 27 to come away from the limit stop 14 and consequently causes the openings 13 to be opened.

As the pressure in the chamber 15 tends towards zero and as there is a difference in cross sectional area of the faces 16' and 16" of the valve element 16, the valve 16 opens again, which allows the filling hose to be drained. When the liquid rises up inside the internal tube 21 and reaches the lower end of the moving parts 24, the valve 34 shuts off the drainage orifice of the annular chamber 30.

The flexible filling hose is emptied, that is to say that the liquid contained in the said flexible filling hose is allowed to flow into the fill limiter and then into the storage tank or reservoir.

If the person responsible for filling opens the shut-off valve of the tanker lorry again, the liquid in the tank reaches a level $N_2$ higher than the level $N_1$. The rise of the liquid inside the tank and inside the internal tube 21 causes the moving parts 24 to move upwards and closes the valve 16.

While the moving parts are moving upwards, the air contained in the front chamber 8 is discharged to the atmosphere through the orifices 22 and 7.

When the tank is being drained and when the liquid level drops back below the moving parts 24, the small valve 34, hitherto pressed against its seat by the liquid, opens to allow the liquid contained in the annular chamber 30 to flow into the tank.

What is claimed is:

1. Fill limiter for a liquid storage tank, said limiter being adapted to be at least partially introduced into said storage tank and comprising:

a hollow upper body, a drop tube secured to said upper body and having a bottom open end and a chamber formed at least partially inside said drop tube, a valve element mounted in said hollow upper body and capable of being moved between an open position and a closed position, a valve seat formed in said hollow upper body and against which said valve element rests in said closed position, a float which can move vertically in said chamber, said valve element and said drop tube being arranged to permit the liquid fed into said hollow upper body to pass said valve element and be discharged in said storage tank through said bottom end of said drop tube, moving parts forming a piston body located inside a stationary internal tube which is housed in said drop tube and secured to said hollow upper body, said float being secured to said moving parts to be moved therewith by the thrust of the liquid exerted on said moving parts inside said internal tube.

2. Limiter according to claim 1 wherein said internal tube is provided with a central through passage formed between said moving parts.

3. Limiter according to claim 2, wherein the float is formed with a central bore approximately coaxial with the said central through passage of the piston body, the float further having a tube placed in the said central bore of the float.

4. Limiter according to claim 2, wherein the internal tube has a lower end, said limiter further having a grating closing said lower end of said internal tube.

5. Limiter according to claim 2, wherein the internal tube comprises an upper part provided with an air discharge orifice, said hollow upper body having a vent orifice in flow communication with said discharge orifice.

6. Limiter according to claim 2, wherein the piston body is equipped with a valve element at its lower end.

7. Limiter according to claim 2, wherein the moving parts of the float have at least one channel spaced laterally from said central through passage, said one channel having opposite ends, said piston body further having a front chamber and a rear chamber formed above and below the moving parts, respectively, said opposite ends of said one channel opening into said front and rear chambers, said valve element further having an intermediate piece mounted in said front chamber and secured to the hollow upper body and said float and provided with a channel coaxial with said central through passage of said piston body.

8. Limiter according to claim 1, characterized in that the float (26) comprises at least one through passage (31), one end of which opens into a front chamber (8) formed between an intermediate piece (9) secured to the upper body (1) and the said float (26), and the other end of which opens into the piston body (25).

9. Limiter according to claim 8, wherein the intermediate piece comprises at its top a limit stop against which the tube of the float abuts, and, two orifices, through which a downstream chamber formed at the rear face of the valve element can be connected to the inside of the said tube of said valve element, said tube being able to move in said passage formed in the intermediate piece.

10. Limiter according to claim 9, wherein the intermediate piece comprises at least one port, said hollow upper body being provided with a lateral duct being in flow communication with said front chamber through said one port, and with a duct valve selectively closing said one port, said valve element having an upstream chamber formed above said cone and in flow communication with said lateral duct.

11. Limiter according to claim 1, wherein the valve element has a conical shape and is equipped at the top of the cone with a passage, said valve element having a front face and rear face communicating via said passage.

12. A fill limiter for controlling a liquid flow, comprising:

an elongated outer tube extending along a longitudinal axis and receiving a liquid, said outer tube having a top end, a bottom, which is adapted to be submerged in a liquid storage tank, and an inner peripheral wall;

an inner tube mounted in said outer tube and spaced radially inwardly from said inner peripheral wall, so that said outer and inner tubes form an axial passage traversed by the liquid, an interior of said inner tube being in flow communication with said passage;

a piston mounted in said inner tube and having a respective top end;

a float attached to said top end of and axially displaceable with said piston in said inner tube toward and away from a blocking position, which corresponds to a predetermined level of liquid in said liquid storage tank; and a valve element mounted in said outer tube between said top ends of said outer and inner tubes and displaceable between a closed position, wherein the liquid flow is interrupted after said float has reached said blocking position, and an open position; said bottom of said outer tube being open to said liquid storage tank to allow liquid traversing said passage to be discharged in said open position of said valve element.

* * * * *